US008033751B2

(12) United States Patent
Yost

(10) Patent No.: US 8,033,751 B2
(45) Date of Patent: Oct. 11, 2011

(54) GYRO COMPENSATED INCLINOMETER FOR CROSS SLOPE CONTROL OF CONCRETE SCREED

(75) Inventor: Jerald Wayne Yost, Casstown, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 39 days.

(21) Appl. No.: 12/575,533

(22) Filed: Oct. 8, 2009

(65) Prior Publication Data

US 2011/0085859 A1 Apr. 14, 2011

(51) Int. Cl.
*E01C 19/22* (2006.01)

(52) U.S. Cl. ..... 404/84.05

(58) Field of Classification Search ..... 404/83–86
See application file for complete search history.

(56) References Cited

U.S. PATENT DOCUMENTS

| | | | | |
|---|---|---|---|---|
| 3,637,026 | A * | 1/1972 | Snow | 172/4.5 |
| 3,953,145 | A * | 4/1976 | Teach | 404/84.5 |
| 5,549,412 | A * | 8/1996 | Malone | 404/84.1 |
| 5,556,226 | A | 9/1996 | Hohmann, Jr. | |
| 6,330,503 | B1 * | 12/2001 | Sharp et al. | 701/50 |
| 6,530,720 | B1 * | 3/2003 | Green | 404/84.1 |
| 6,530,721 | B2 * | 3/2003 | Yost | 404/84.5 |
| 6,672,797 | B1 | 1/2004 | Zachman et al. | |
| 6,723,796 | B2 * | 4/2004 | Goldblatt et al. | 525/279 |
| 7,144,191 | B2 * | 12/2006 | Kieranen et al. | 404/84.1 |
| RE39,834 | E * | 9/2007 | Kieranen et al. | 404/84.5 |
| 7,854,565 | B2 * | 12/2010 | Halonen et al. | 404/75 |
| 2002/0127058 | A1 | 9/2002 | Zachman et al. | |
| 2002/0154948 | A1 | 10/2002 | Brabec et al. | |
| 2004/0086337 | A1 | 5/2004 | Zachman et al. | |

* cited by examiner

*Primary Examiner* — Raymond Addie
(74) *Attorney, Agent, or Firm* — Dinsmore & Shohl LLP

(57) ABSTRACT

A control system for controlling movement of individual hydraulically moveable ends of a screed head carried by a boom of a machine so as to maintain a selected elevation position between each end of the screed head and a reference in a concrete paving application as the screed head is moved toward the machine, includes elevation receivers mounted on the ends of the screed head, and a first sensor for sensing the orientation of the screed head along its length from the first end to the second end of the screed head. A second sensor senses rotational movement of the machine which will induce an error in the output of the first sensor, and providing an output indicating such rotational movement. A control circuit is responsive to the elevation receivers and to the first and second sensors for controlling the hydraulically moveable ends of the screed head using the signals from the elevation receivers when they are not blocked, and for controlling the hydraulically movable ends of the screed head using the signals from the first and second sensors, and one of the elevation receivers when the other of the elevation receivers is blocked.

18 Claims, 6 Drawing Sheets

GYRO COMPENSATED INCLINOMETER FOR CROSS SLOPE CONTROL OF CONCRETE SCREED

STATEMENT REGARDING FEDERALLY SPONSORED RESEARCH OR DEVELOPMENT

Not applicable.

BACKGROUND

In concrete paving operations, after concrete is poured, it is commonly finished by drawing a tool, such as a screed head, over the surface of the concrete. The screed head smoothes the concrete surface before the concrete has cured completely. Similarly, after asphalt is laid, it is commonly leveled to a desired depth by drawing a tool, similar to a screed head, over the surface to finish the surface and control the thickness of the asphalt. Additionally, in grading operations, a surface is graded by drawing a blade of a grader over the surface. Although the physical configurations of the various types of screed heads and blades differ, the functions of these tools are analogous.

Typically, support structures including hydraulic cylinders support the ends of the tool on such machines. The hydraulic cylinders can be actuated to raise and lower the ends of the tool independently. It has been common to determine the elevation positions of the ends of the tool by using a laser transmitter and a pair of laser beam receivers that are mounted on masts at each end of the tool. The laser transmitter provides a rotating beam of laser light that is sensed by the receivers. The tool is raised and lowered under control of a system that sets the ends of the tool at vertical positions in dependence upon a desired elevation for the tool and the sensed elevation of the ends of the tool.

The laser transmitter may project a beam of laser light that rotates in a reference plane. The laser receivers detect the reference plane and the relative elevation of the ends of the tool with respect to the reference plane. A control system of the machine then actuates hydraulic valves to supply fluid to the hydraulic cylinders in response to these detected levels. As a result, the elevation of each end of the tool can be precisely controlled. Each of the receivers provides feedback to drive the hydraulics controlling the elevation of the end of the tool with which it is associated.

If one of the receivers is blocked by something at the worksite, such as, for example, a support column, the proper operation of the system is interrupted. This commonly occurs when concrete is being finished on the floor of a building interior. When a blockage occurs, there is a need to maintain the relative elevation of the ends of the tool as it is drawn toward the machine until the laser beam can be reacquired by both receivers. One approach to this problem is to set up two laser transmitters at the same elevation on opposite sides of the tool. In this way, if a column blocks one of the transmitters, the other transmitter is likely to be illuminating the receivers at the ends of the tool, thereby compensating for the blockage. Essentially, this eliminates all blind spots around the receivers. While generally effective, this prior art method is disadvantageous in that by requiring an additional transmitter, the cost of the equipment is increased. Further, this method increases significantly the time required to set up the equipment and eliminate the possibility of a column block with the second laser transmitter.

Other approaches have been used to deal with the problem of one of the receivers not receiving the reference beam of laser light. Such approaches may involve providing an additional sensor or additional sensors, the output from which are used when one of the laser receivers is blocked. For example, a gravity based cross slope sensor may be mounted on the tool to indicate the inclination of the tool between the laser receivers. In such a system, when the laser beam reception of one of the laser receivers is blocked, the system will be operated using the laser receiver output that is not blocked to control the vertical movement of the end of the tool with which it is associated. The vertical movement of the other end of the tool is controlled to maintain as constant the inclination of the tool sensed just prior to losing reception of the laser beam. When reception of the beam by both receivers is restored, normal operation of the system based on the two receivers is resumed.

A problem that results from the use of a gravity based inclinometer as an additional sensor input is that such sensors are subject to significant inaccuracies when the tool is subjected to lateral acceleration. In screeding operations, it is common for the operator of the machine to side shift the tool around columns as the tool is being pulled toward the machine. Since the sensitive axis of the gravity based cross slope sensor is parallel to the length of the tool, side shifting can cause noticeable acceleration along the sensitive axis of measurement. This dramatically affects the feedback of the cross slope sensor. In order to reduce the effects of noise and to compensate for some of the low frequency harmonics of machine vibration, the cross slope sensor output is typically supplied to a low pass filter. However, providing a low pass filter on the output of the gravity based cross slope sensor adds an inherent time lag to the system, however, that degrades the bandwidth performance of the blocked side. The low pass filter does not, however, limit the errors induced by lateral shifts in the tool, since these shifts result in fairly low frequency error signals. Another approach that is not subject to errors from lateral shifts is to provide extension sensors on the two hydraulic cylinders that control the vertical position of the two ends of the tool. When the beam to one of the laser receivers is blocked, the cylinder at that end of the tool is driven on the basis of the difference in cylinder extension sensor outputs, while the hydraulic cylinder at the other end of the tool is driven based on the received beam. While this avoids the problems associated with lateral shift acceleration, the accuracy achieved is not as great as desired.

SUMMARY

A control system for controlling movement of individual hydraulically moveable ends of a screed head carried by a boom of a machine maintains a selected elevation position between each end of the screed head and a reference in a concrete paving application as the screed head is moved toward the machine. The system includes an elevation receiver, mounted on a first end of the screed head, that provides a first signal indicating the position of the first end of the screed head in relation to the reference. The system further includes an elevation receiver, mounted on a second end of the screed head, that provides a second signal indicating the position of the second end of the screed head in relation to the reference. A first sensor is mounted on the screed head for sensing the orientation of the screed head along its length from the first end to the second end. The first sensor provides a third signal indicating such orientation. A second sensor senses rotational movement of the machine which will induce an error in the third signal. The second sensor provides a fourth signal indicating such rotational movement. A control circuit is responsive to the elevation receivers and to the first and second sensors. The control circuit controls the hydraulically moveable ends of the screed head using the first and second signals from the elevation receivers when the first and second signals are available. The control circuit controls the hydraulically moveable ends of the screed head using the third signal from the first sensor and the fourth signal from the second sensor, and one of the first and second signals from the elevation receivers when the other of the first and second signals is not available.

The control circuit maintains the screed head in an orientation such that the inclination of the screed head remains substantially constant when one of the first and second signals from the elevation receivers is not available, whereby the orientation of the screed head along its length from the first end to the second end is maintained substantially constant. The first sensor may be an inclinometer mounted on the screed head and the second sensor may include a gyroscope for sensing rotation of the machine. The inclinometer may be a pendulum sensor with a low pass filtered output. The control system may further comprise a third sensor, mounted on the machine, for sensing the distance between the first sensor and the axis of rotation of the machine. The acceleration of the second sensor due to rotation of the machine may be determined and compensation provided for errors resulting therefrom.

The receivers may be light detectors, and the reference is then established by a beam of light. More particularly, the receivers may be laser light detectors and in this case the reference is established by a beam of laser light.

A control system controls movement of individual hydraulically moveable ends of an elongated tool to maintain a selected elevation position between each end of the tool and a reference. The control system includes a first elevation receiver, mounted on a first end of the tool, providing a first signal indicating the position of the first end of the tool in relation to the reference, and a second elevation receiver, mounted on a second end of the tool, providing a second signal indicating the position of the second end of the tool in relation to the reference. A first sensor is mounted on the tool for sensing the orientation of the tool along its length from the first end to the second end and for providing a third signal indicating such orientation. A second sensor is provided for sensing movement of the tool in a direction generally parallel to the direction of elongation of the tool and for providing a fourth signal indicating such movement. A control circuit, responsive to the elevation receivers and to the first and second sensors, controls the hydraulically moveable ends of the tool using the first and second signals from the elevation receivers when the first and second signals are available. The control circuit controls the hydraulically moveable ends of the tool using the third and fourth signals from the first and second sensors and one of the first and second signals from the elevation receivers when the other of the first and second signals is not available.

The first sensor may be an inclinometer mounted on the tool. The control circuit maintains the tool in an orientation when one of the first and second signals from the elevation receivers is not available, whereby the slope of the tool along its length from the first end to the second end also is maintained substantially constant. The inclinometer may be a pendulum sensor with a low pass filtered output.

A method of controlling the elevation position of hydraulically moveable ends of an elongated tool in relation to a reference detected by elevation receivers attached to the ends of the tool, when reception of one of the elevation receivers of the reference is interrupted, includes the steps of: (a) selecting a desired elevation position of the tool with respect to the reference; (b) sensing with the elevation receivers the position of the ends of the tool in relation to the reference; (c) sensing the inclination of the tool along its length from one end to the other with a gravity reference inclinometer; (d) correcting the sensed inclination of the tool along its length for errors resulting from movement of the tool in a direction generally parallel to the direction of elongation of the tool; and (e) controlling the elevation positions of the ends of the tool using the sensed positions of the ends of the tool in relation to the reference when such positions are both known, and controlling the elevation positions of the ends of the tool using the sensed position of one of the ends of the tool and the sensed inclination of the tool along its length from one end to the other when the elevation positions of both ends of the tool are not known.

The step of correcting the sensed inclination of the tool along its length for errors resulting from movement of the tool in a direction generally parallel to the direction of elongation of the tool may include the steps of detecting lateral movement of the tool generally in the direction of elongation of the tool, determining the acceleration of the tool generally in the direction of elongation of the tool, and recalculating the inclination of the tool based on the acceleration force applied to the tool as a result of such acceleration. The step of sensing the orientation of the tool along its length may include the step of sensing the orientation of the tool using an inclinometer. The step of sensing with the elevation receivers the position of the ends of the tool in relation to the reference may include the steps of providing a rotating beam of light as a reference, and sensing the rotating beam of light with light detectors. The step of providing a rotating beam of light as a reference may include the step of providing a rotating beam of laser light, and the step of sensing the rotating beam of light with light detectors may include the step of sensing the rotating beam of laser light with laser light detectors.

DETAILED DESCRIPTION OF THE PREFERRED EMBODIMENT

Figure 1:
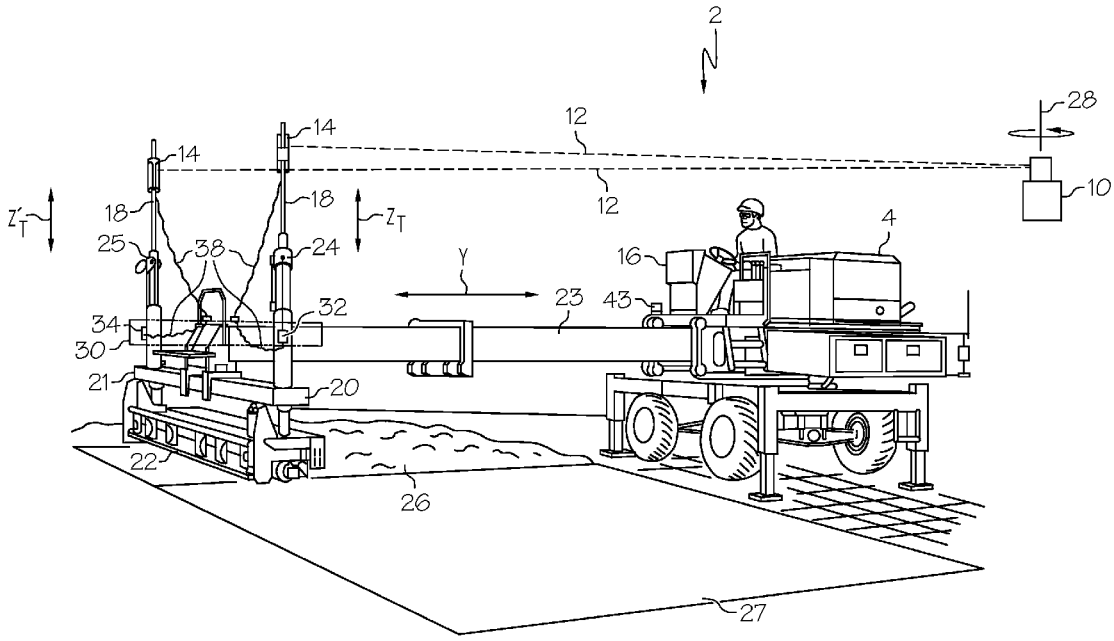
FIG. 1 (PRIOR ART)
FIG. 1 illustrates a screeding operation of a typical prior art concrete screed.

FIG. 1 illustrates a prior art screeding machine 2 for smoothing the surface 26 of a quantity of concrete 27 which has been poured onto, and generally spread over, a floor support surface. The machine 2 includes a screed head 22 that is pulled over the surface 26 of the concrete 27. The control of the screeding machine 2 is accomplished using an external laser transmitter 10, transmitting a rotating laser beam 12, to provide a reference plane of laser light. The plane of laser light is sensed by a pair of laser receivers 14, and the output of these receivers is supplied to a control system 16 that effects control of electrically actuated hydraulic valves. These valves, in turn, control the flow of hydraulic fluid to hydraulic cylinders 24 and 25 that determine the vertical height of the two ends of the screed head 22.

The concrete screeding machine 2 further includes a pair of masts 18, each carrying one of the pair of laser receivers 14. The masts 18 are attached to and move generally vertically with respective ends 20 and 21 of the screed head 22. The screed head 22 is attached to the end of a hydraulic boom arm 23 which moves the screed head 22 in a longitudinal direction Y toward and away from the body 4 of the machine. Typically, the screeding process is accomplished as the screed head 22 moves toward the body 4. During normal operation, the control system 16 controls actuation of the hydraulic valves such that hydraulic cylinders 24 and 25 independently raise and lower the ends of the screed head 22, as indicated by vertical arrows $Z_T$ and $Z_T'$, as the screed head 22 is drawn in the direction Y over the surface of uncured concrete 26. It will be appreciated that the vertical movement of the screed head 22 is based on the sensed vertical position of the beam of laser light with respect to the screed head 22, and the desired vertical position of the beam of laser light with respect to the screed head 22.

A difficulty arises when the path of the laser beam 12 to one of the pair of laser receivers 14 is temporarily blocked by a column or other obstruction at the work site. To deal with this eventuality, an additional linear transducer arrangement, indicated generally by 30, is mounted on each side of the tool or screed head 22 on the respective masts 18. The linear transducer 30 may comprise a pair of linear transducers 32 and 34. Each of the pair of linear transducers 32 and 34 provides an electrical output indicating the extension of the associated hydraulic cylinder 24 and 25 upon which it is mounted. It is to be appreciated that any variety of linear transducers 32 and 34, such as string encoders, sonic transducers, laser transducers, linear variable differential transformer (LVDT), and the like may be used to measure the extensions of hydraulic cylinder 24 and 25.

The transducer arrangement 30, in a similar manner as the pair of elevation receivers 14, is electrically coupled to the control system 16 via electrical lines 38, which also provide power thereto. After an initial calibration, the transducer arrangement 30 provides output signals to the control system 16, indicating the relative height of the masts 18. The control system 16 uses the output signals of the transducer arrangement 30 to determine and control the relative heights of the two ends 20 and 21 of the screed head 22 when one of the normally absolute measurements provided by the pair of elevation receivers 14 is unavailable due to a column block situation or other disruption.

In the prior art system of FIG. 1, when one of the pair of elevation receivers or laser receivers 14 does not receive the laser beam 12, the associated linear transducer 32 or 34 for the hydraulic cylinder 24 or 25 is used as the control input for that side of the tool or screed head 22. Since the elevation of the laser receiver 14 at the opposite end of the tool or screed head 22 is known, and the relative extension of the two hydraulic cylinders 24 and 25 is known from the outputs of the linear transducers 32 and 34, the elevation of the end of the tool or screed head 22 associated with the blocked receiver can be determined. Thus, the control system 2 uses the output of the linear transducer 32 or 34 associated with the blocked end 20 or 21 to maintain a constant relative height between the ends 20 and 21 until the disruption clears.

Figure 2:
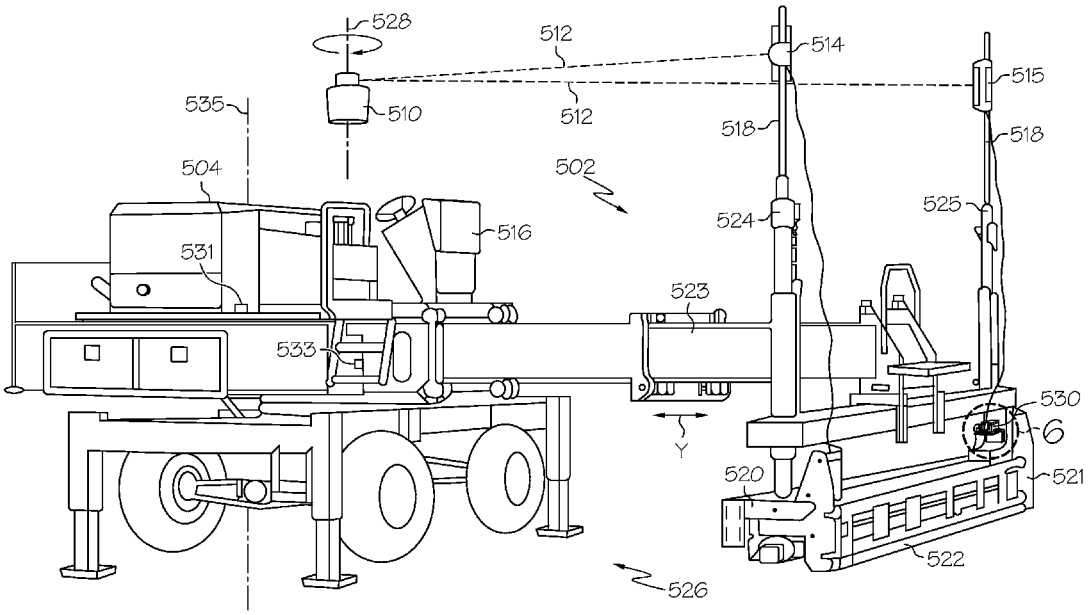
FIG. 2 illustrates a screeding operation of a typical concrete screed and embodiment of the control system.

FIG. 2 illustrates an embodiment of the improved system. The control system for a machine 502, which may be a concrete screed 504, incorporates a laser transmitter 510 mounted in a stationary position. The transmitter 510 projects a rotating laser beam 512, to provide a reference. A pair of elevation receivers, such as laser receivers 514 and 515, and a control box 516 including a control circuit are provided for controlling the control valves (not shown) of the concrete screed 504. The concrete screed 504 further includes a pair of masts 518, each carrying one of the laser receivers 514 and 515, attached to, and moveable generally vertically with, respective ends 520 and 521 of the screed head 522. The screed head 522 is attached to the end of a hydraulic boom arm 523 which moves the screed head 522 in longitudinal direction Y. During operation of the screed, the control box 516 controls the actuation of hydraulic valves such that hydraulic cylinders 524 and 525 independently raise or lower the ends 520 and 521 of the screed head 522 as it is drawn in the direction Y over the surface of uncured concrete 526. Moving the screed head 522 in the vertical direction is accomplished in response to reception of the reference laser beam 512 by the pair of laser receivers 514 and 515. The laser beam 512 rotates about an axis, indicated at 528, to define a reference plane of laser light. The first and second receivers 514 and 515 provide respective first and second signals indicating the position of the respective ends of the screed head 522 in relation to the reference 512.

Figure 3:
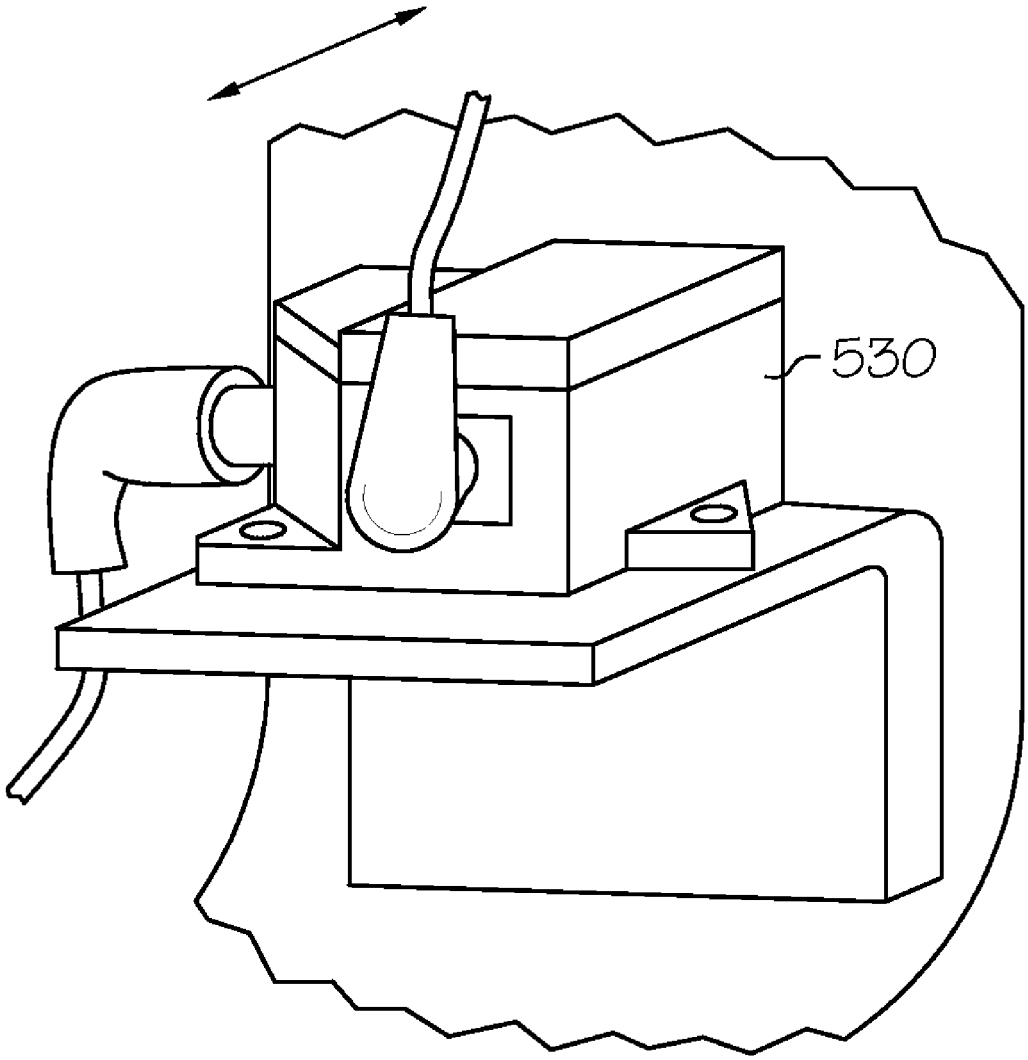
FIG. 3 is an enlarged partial view of an inclinometer mounted on the screed head.

As discussed above, a difficulty arises with the conventional control system of this type when the path of the laser beam 512 to one of the pair of elevation receivers 514 is temporarily blocked by a column or other obstruction at a work site. It should be understood that although an arrangement using laser receivers on masts detecting a rotating reference laser beam is disclosed, other arrangements for determining the height of the ends of the screed are also contemplated, including for example total station systems, GPS systems, and laser transmitters projecting fan-shaped beams. All of these types of systems are subject to having temporary blockage of reception by a receiver at one end of the screed head. In the embodiment of FIG. 2, this difficulty is addressed by the use of additional sensors. A sensor 530 is mounted on the screed head 522 for sensing the orientation of the screed head 522 along its length from the first end to the second end. The sensor 530 may be an inclinometer that is mounted on the screed head, as illustrated in FIG. 3. The sensor 530 provides a third signal that indicates the orientation of the screed head along its length.

The system includes a second sensor 531 for sensing rotational movement of the machine which will induce an error in the third signal from the first sensor 530 and providing a fourth signal indicating such rotational movement. The sensor 531, shown in FIG. 2 as mounted on the machine, may be any of a number of known sensors, such as for example a gyro-based MEMS sensor, or a conventional angular rotation sensor mounted at the rotation axis. Sensor 531 may alternatively be mounted on the screed head 522, adjacent the sensor 530, if a gyro-based sensor is used to determine rotational movement. It will be appreciated that it may be necessary to pivot the machine 504 as the screed head 522 is drawn over the concrete in order to avoid contact with columns or other obstructions at the worksite. The system also includes a third sensor 533, mounted on the machine for sensing the distance between the first sensor 530 and the axis of rotation 535 about which the machine 504 is pivoted. Sensor 533 may be of a number of types of sensors, including a string encoder for determining the extension of the arm 523. By determining the distance R from the axis 535 to the screed head 522 and sensor 530, and the change in rotational velocity of the machine about axis 535, it is possible to determine the error in the third signal from the first sensor 530 that is induced by lateral acceleration forces.

A control circuit 516 is responsive to the elevation receivers 514 and 515 and to the sensor 530 for controlling the hydraulically moveable ends 520 and 521 of the screed head 522 using the first and second signals from the elevation receivers 514 and 515 when the first and second signals are available. As explained below, the control circuit 516 controls the hydraulically moveable ends 520 and 521 of the screed head 522 using the third signal from the sensor 530 and one of the first and second signals from the elevation receivers 514 and 515 when the other of the first and second signals is not available. The control circuit maintains the screed head 522 in an orientation such that the third signal remains substantially constant when one of the first and second signals from the elevation receivers 514 and 515 is not available. By this approach, the screed head 522 is also maintained in a substantially constant orientation along its length from the first end to the second end.

Figure 4:
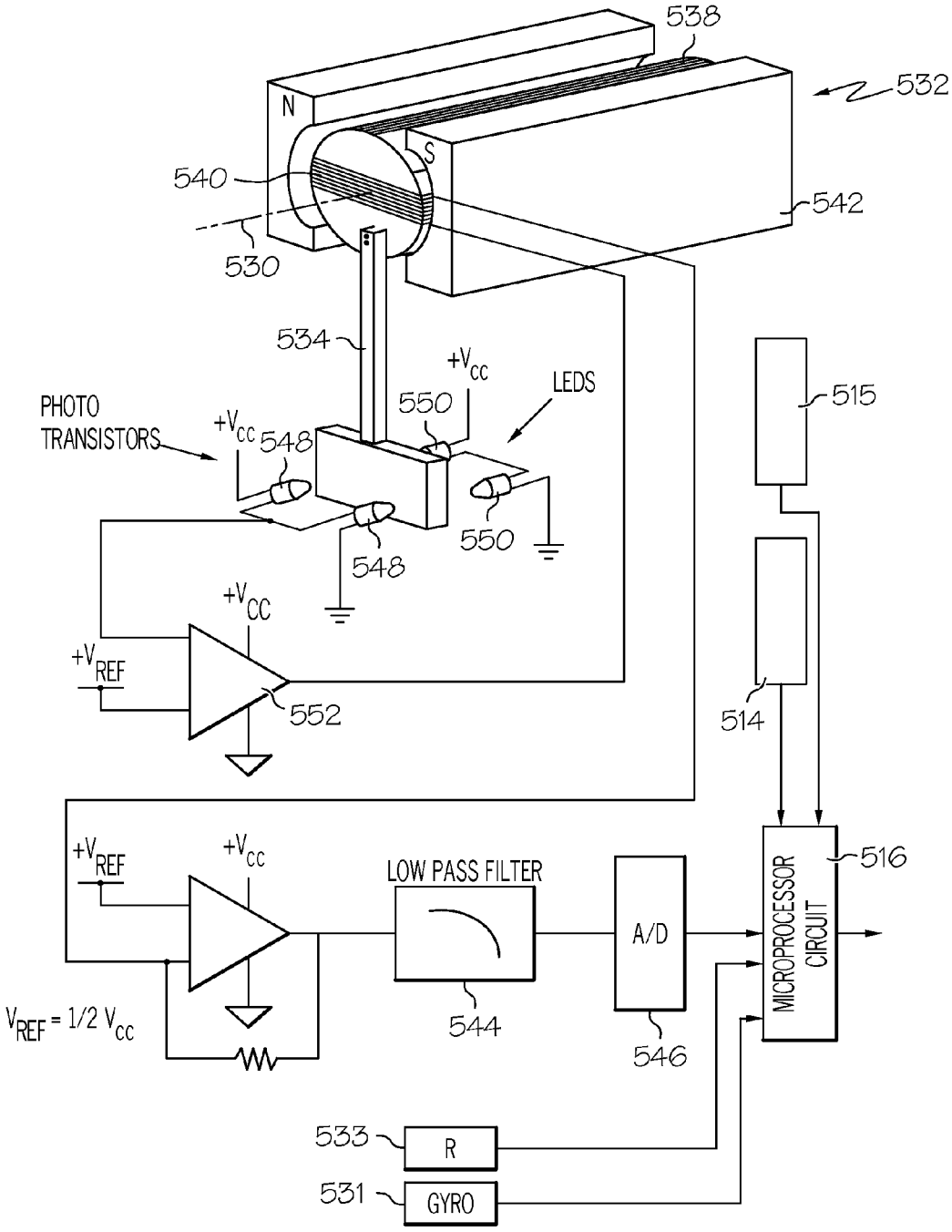
FIG. 4 is a schematic representation of an inclinometer and associated circuitry.

As stated above, the sensor 530 may be an inclinometer, such as the pendulum sensor inclinometer 532 shown in FIG. 4 with associated circuitry. The illustrated inclinometer 532 incorporates a pendulum arm 534 which pivots about axis 536, moving rotor 538. Rotor 538 includes a plurality of windings 540 which rotate with the rotor and which cooperate with a permanent magnet stator 542. The output from the windings 540 is supplied to a low pass filter 544, and is then digitized in A-D converter 546. As will be appreciated, phototransistors 548 cooperate with LED's 550 to determine when the inclinometer has been pivoted sufficiently that the pendulum 534 does not prevent the light from the LED's 550 from striking the transistors 548. When one of the transistors 548 is illuminated, a signal is applied to amplifier 552 which then drives windings 540 until the pendulum 534 is brought back into position to shield both of the phototransistors 548. The amplitude of this driving current provides an indication of the degree of inclination of the sensor 530. The output of A-D converter 546 is supplied to microprocessor control circuit 516 which is also responsive to the elevation receivers 514 and to the first and second sensors 532 and 531, for controlling the hydraulically moveable ends of the screed head 522 using the first and second signals from the elevation receivers 514 when the first and second signals are available. Although a pendulum sensor inclinometer is shown, it will be appreciated that any other type of inclinometer may be used instead. For example, a MEMS based inclinometer may also be used in place of a pendulum based inclinometer. One such inclinometer is Model SCA 100T-D02, available from VTI Technologies Oy, Vantaa, Finland.

The hydraulically moveable ends of the screed head 522 are controlled using the third signal from the first sensor 530 and the fourth signal from the second sensor 531, along with one of the first and second signals from the receivers 514 when the others of the first and second signals is not available. The approach is to maintain the screed head 522 at a substantially constant inclination when one of the signals from the elevation receivers 514 and 515 is not available. The third sensor 533 senses extension of boom arm 523 and provides an output related to the distance R between the first sensor 530 and the axis of the rotation 535 of the machine. With this information, the acceleration of the inclinometer due to rotation of the machine can be determined and compensation can be provided for the error in the angle reading of the inclinometer. The error in angular measurement induced by lateral acceleration of the screed as it is shifted around obstructions is $$\ominus_{E=tan}{}^{-1}(R/g)(dw/dt),$$

where w is the angular velocity of the machine rotating around axis 535, and g is the acceleration due to gravity.

Figure 5:
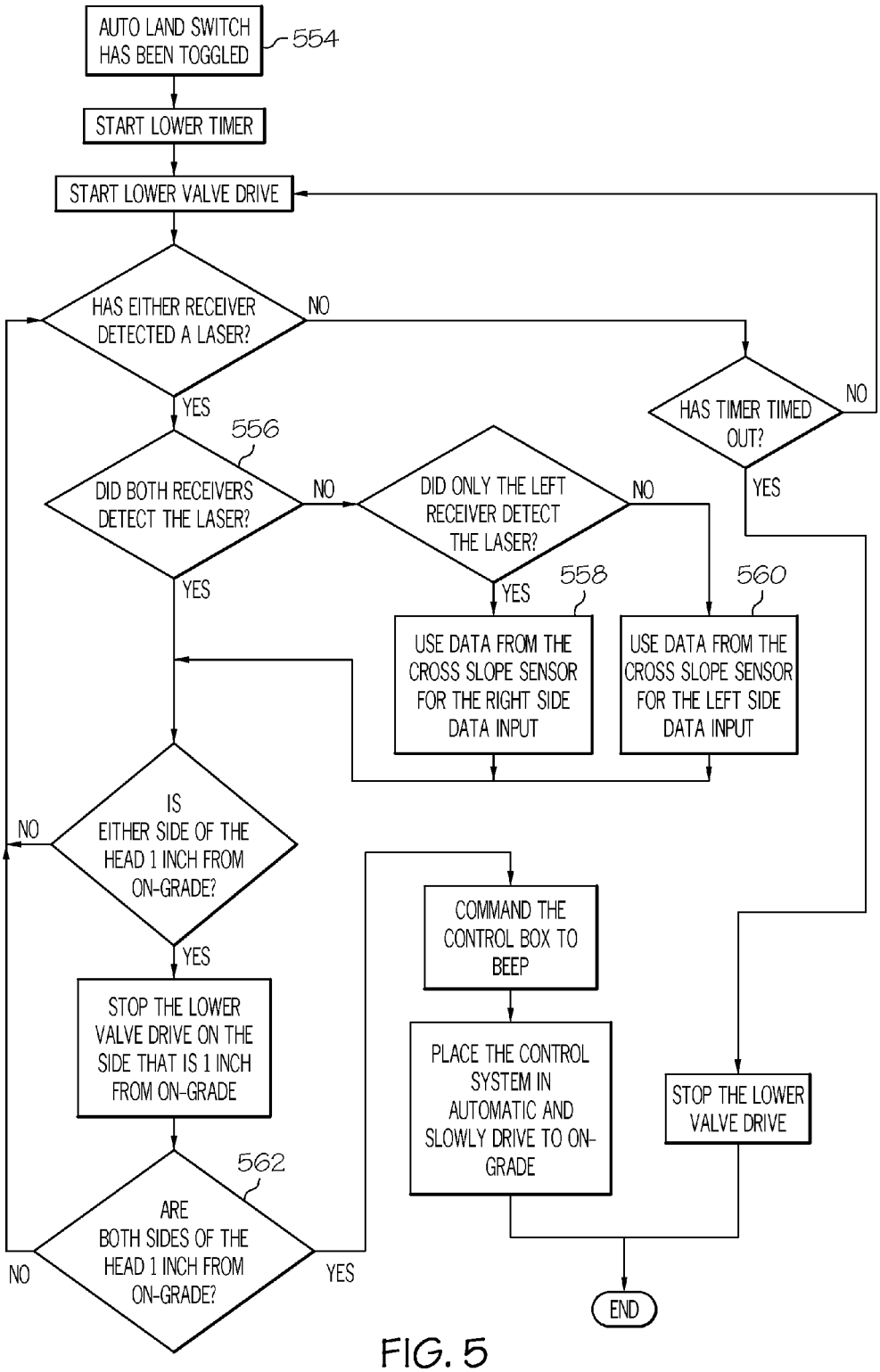
FIG. 5 is a first flow chart diagram illustrating operation of the system.
Figure 6:
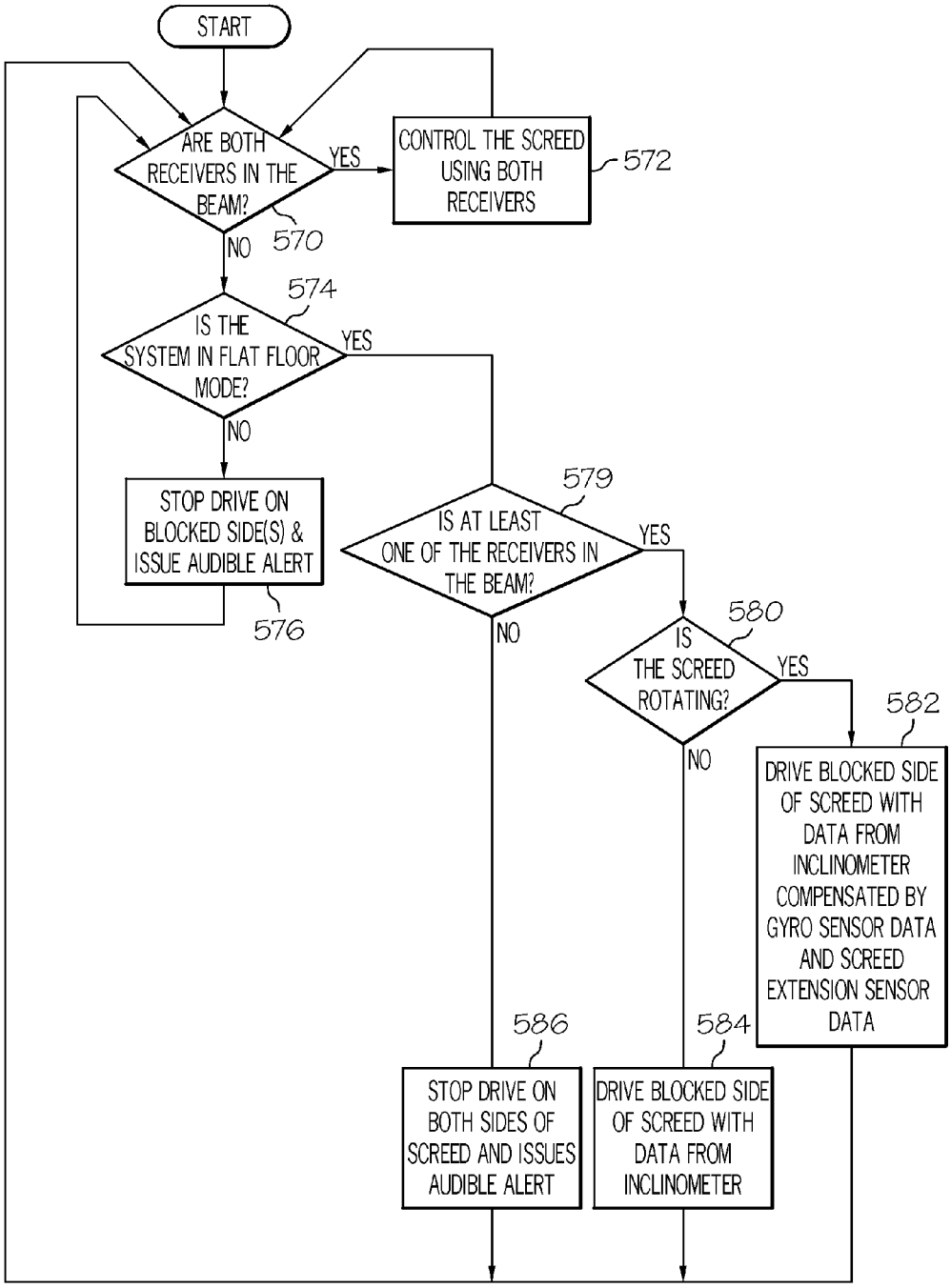
FIG. 6 is a second flow chart diagram illustrating operation of the system.

Reference is now made to FIGS. 5 and 6, which are flow chart diagrams illustrating the manner in which the operator smoothes the concrete surface as he repeatedly pulls the screed head 522 toward the machine 504. As shown in FIG. 5, the operator extends the boom 523 and toggles the land switch on control box 516, as indicated at 554. A timer and a lower valve drive are initiated. If either receiver 514 or 515 has detected the laser reference 512 at 556, but not both, then the data from the sensor 530 is used at 558 and 560 in place of the missing data from the receivers. The valve drives for both sides of the screed head are stopped at 562 when the screed head is one inch from being at the correct height, i.e., "on grade." The system is then placed in automatic mode, and the screed head is slowly lowered to the on-grade height. The hydraulic boom arm 523 is then retracted and the screed head smoothes the concrete surface 526.

If a signal from one of the receivers 514 and 515 is not available during retraction of the screed head, the control circuit maintains the screed head in an orientation such that the third signal from the sensor 530 remains constant. By this approach, the slope of the screed head along its length from the first end to the second end also is maintained substantially constant until the receiver 514 or 515 reacquires the beam 512.

Depending upon the configuration of the structure around the concrete surface being smoothed by the screed head, it may not be possible to move the screed head in a straight line toward the machine. It may, for example, be necessary for the operator to shift the beam 523 from side to side to avoid columns and the like as the screed is moved. This will, of course, induce an error in the output of the sensor 530. To avoid inaccurate screeding of the surface that would result from this, the lateral movement of the screed head generally in the direction of the length of the screed head 522 is detected. The microprocessor circuit 516 uses the outputs from sensors 531 and 533 to determine the induced error in the output of the inclinometer 532, and appropriate compensation in this output is effected.

As explained more fully in FIG. 6, a determination is made at 570 as to whether both receivers are "in the beam," i.e., are receiving the reference beam 512. If they are in the beam, then the screed height is controlled using both receivers, as indicated at 572. This is checked repeatedly. When both receivers are not receiving the beam, a check is made as to whether the system is set in the "flat floor" mode at 574. If it is not, then a drive is blocked on the blocked side and an audible warning sounded at 576. If the system is in the "flat floor" mode, however, a determination is made at 579 as to whether at least one of the receivers is in the beam. If one of the receivers is receiving the beam, a decision is made at 580 as to whether the screed is shifting laterally or rotating about an axis 535. If the screed is not shifted laterally, then the side of the screed that is blocked is controlled based on the inclinometer output at 582. If the screed is shifted laterally, or rotated about the axis 535, however, then the blocked side of the screed is controlled at 582 with data from the inclinometer compensated by the sensor data from sensor 533. If, on the other hand the screed is not moved laterally or rotated, then the blocked side of the screed is controlled with uncompensated data from the inclinometer at 584. Note that the process is then repeated continuously with the system checking for to see whether the beam is blocked to either of the receivers. If neither of the receivers receives the beam, of course, then there is not sufficient data to control screed height, and an alarm is sounded at 586.

What is claimed is:

1. A control system for controlling movement of individual hydraulically moveable ends of a screed head carried by a boom of a machine so as to maintain a selected elevation position between each end of the screed head and a reference in a concrete paving application as the screed head is moved toward the machine, comprising:

an elevation receiver, mounted on a first end of the screed head, providing a first signal indicating the position of the first end of the screed head in relation to the reference;

an elevation receiver, mounted on a second end of the screed head, providing a second signal indicating the position of the second end of the screed head in relation to the reference;

a first sensor, mounted on the screed head, for sensing the orientation of the screed head along its length from the first end to the second end and providing a third signal indicating such orientation;

a second sensor for sensing rotational movement of the machine about a generally vertical axis which will induce an error in the third signal from the first sensor and providing a fourth signal indicating such rotational movement; and a control circuit, responsive to the elevation receivers and to the first and second sensors, for controlling the hydraulically moveable ends of the screed head using the first and second signals from the elevation receivers when the first and second signals are available, and for controlling the hydraulically moveable ends of the screed head using the third signal from the first sensor and the fourth signal from the second sensor, and one of the first and second signals from the elevation receivers when the other of the first and second signals is not available.

2. The control system according to claim 1 for controlling movement of individual hydraulically moveable ends of a screed head carried by a boom of a machine to maintain a selected elevation for each end of the screed head as the screed head is moved toward the machine, in which the control circuit maintains the screed head in an orientation such that the inclination of the screed head remains substantially constant when one of the first and second signals from the elevation receivers is not available, whereby the orientation of the screed head along its length from the first end to the second end is maintained substantially constant.

3. The control system according to claim 1 for controlling movement of individual hydraulically moveable ends of a screed head carried by a boom of a machine to maintain a selected elevation for each end of the screed head as the screed head is moved toward the machine, in which the first sensor is an inclinometer mounted on the screed head and in which the second sensor includes a gyroscope for sensing rotation of said machine about a generally vertical axis.

4. The control system according to claim 3 for controlling movement of individual hydraulically moveable ends of a screed head carried by a boom of a machine to maintain a selected elevation for each end of the screed head as the screed head is moved toward the machine, in which the inclinometer is a pendulum sensor with a low pass filtered output.

5. The control system according to claim 3 for controlling movement of individual hydraulically moveable ends of a screed head carried by a boom of a machine to maintain a selected elevation for each end of the screed head as the screed head is moved toward the machine, further comprising a third sensor, mounted on the machine, for sensing the distance between said first sensor and said axis of rotation of said machine, whereby the acceleration of said first sensor due to rotation of said machine may be determined and compensation provided for errors resulting therefrom.

6. The control system according to claim 1 for controlling movement of individual hydraulically moveable ends of a screed head carried by a boom of a machine to maintain a selected elevation for each end of the screed head as the screed head is moved toward the machine, in which the receivers are light detectors, and in which the reference is established by a beam of light.

7. The control system according to claim 1 for controlling movement of individual hydraulically moveable ends of a screed head carried by a boom of a machine to maintain a selected elevation for each end of the screed head as the screed head is moved toward the machine, in which the receivers are laser light detectors and in which the reference is established by a beam of laser light.

8. The control system according to claim 1 for controlling movement of individual hydraulically moveable ends of a screed head carried by a boom of a machine to maintain a selected elevation for each end of the screed head as the screed head is moved toward the machine, in which said second sensor is mounted on the machine.

9. The control system according to claim 1 for controlling movement of individual hydraulically moveable ends of a screed head carried by a boom of a machine to maintain a selected elevation for each end of the screed head as the screed head is moved toward the machine, in which said second sensor is mounted on the screed head.

10. A control system for controlling movement of individual hydraulically moveable ends of an elongated tool so as to maintain a selected elevation position between each end of the tool and a reference, comprising:

a first elevation receiver, mounted on a first end of the tool, providing a first signal indicating the position of the first end of the tool in relation to the reference;

a second elevation receiver, mounted on a second end of the tool, providing a second signal indicating the position of the second end of the tool in relation to the reference;

a first sensor, mounted on the tool, for sensing the orientation of the tool along its length from the first end to the second end and providing a third signal indicating such orientation;

a second sensor for sensing movement of said tool in a direction generally parallel to the direction of elongation of said tool and providing a fourth signal indicating such movement; and a control circuit, responsive to the elevation receivers and to the first and second sensors, for controlling the hydraulically moveable ends of the tool using the first and second signals from the elevation receivers when the first and second signals are available, and for controlling the hydraulically moveable ends of the tool using the third and fourth signals from the first and second sensors and one of the first and second signals from the elevation receivers when the other of the first and second signals is not available.

11. The control system for controlling movement of individual hydraulically moveable ends of an elongated tool so as to maintain a selected elevation position between each end of the tool and a reference, according to claim 10, in which the first sensor is an inclinometer mounted on the tool.

12. The control system for controlling movement of individual hydraulically moveable ends of an elongated tool so as to maintain a selected elevation position between each end of the tool and a reference, according to claim 10, in which the control circuit maintains the tool in an orientation when one of the first and second signals from the elevation receivers is not available, whereby the slope of the tool along its length from the first end to the second end also is maintained substantially constant.

13. The control system for controlling movement of individual hydraulically moveable ends of an elongated tool so as to maintain a selected elevation position between each end of the tool and a reference, according to claim 11, in which the inclinometer is a pendulum sensor with a low pass filtered output.

14. A method of controlling the elevation position of hydraulically moveable ends of an elongated tool in relation to a reference detected by elevation receivers attached to the ends of the tool, when reception of one of the elevation receivers of the reference is interrupted, comprising the steps of:

(a) selecting a desired elevation position of the tool with respect to the reference;

(b) sensing with the elevation receivers the position of the ends of the tool in relation to the reference;

(c) sensing the inclination of the tool along its length from one end to the other with a gravity reference inclinometer;

(d) correcting the sensed inclination of the tool along its length for errors resulting from movement of the tool in a direction generally parallel to the direction of elongation of the tool; and (e) controlling the elevation positions of the ends of the tool using the sensed positions of the ends of the tool in relation to the reference when such positions are both known, and controlling the elevation positions of the ends of the tool using the sensed position of one of the ends of the tool and the sensed inclination of the tool along its length from one end to the other when the elevation positions of both ends of the tool are not known.

15. The method of controlling the elevation position of hydraulically moveable ends of an elongated tool in relation to a reference detected by elevation receivers attached to the ends of the tool, when reception of one of the elevation receivers of the reference is interrupted, according to claim 14, in which said step of correcting the sensed inclination of the tool along its length for errors resulting from movement of the tool in a direction generally parallel to the direction of elongation of the tool comprises the steps of:

detecting lateral movement of the tool generally in the direction of elongation of the tool;

determining the acceleration of the tool generally in the direction of elongation of the tool; and recalculating the inclination of the tool based on the acceleration force applied to the tool as a result of such acceleration.

16. The method of controlling the elevation position of hydraulically moveable ends of an elongated tool in relation to a reference detected by elevation receivers attached to the ends of the tool, when reception of one of the elevation receivers of the reference is interrupted, according to claim 14, in which the step of sensing the orientation of the tool along its length includes the step of sensing the orientation of the tool using an inclinometer.

17. The method of controlling the elevation position of hydraulically moveable ends of an elongated tool in relation to a reference detected by elevation receivers attached to the ends of the tool, when reception of one of the elevation receivers of the reference is interrupted, according to claim 14, in which the step of sensing with the elevation receivers the position of the ends of the tool in relation to the reference includes the steps of:

providing a rotating beam of light as a reference, and sensing the rotating beam of light with light detectors.

18. The method of controlling the elevation position of hydraulically moveable ends of an elongated tool in relation to a reference detected by elevation receivers attached to the ends of the tool, when reception of one of the elevation receivers of the reference is interrupted, according to claim 14, in which the step of providing a rotating beam of light as a reference includes the step of providing a rotating beam of laser light, and in which the step of sensing the rotating beam of light with light detectors includes the step of sensing the rotating beam of laser light with laser light detectors.

* * * * *